US005092638A

United States Patent [19]

Mizuki

[11] Patent Number: 5,092,638

[45] Date of Patent: Mar. 3, 1992

[54] CHILD-LOCK MECHANISM FOR LOCKING APPARATUS FOR VEHICLE

[75] Inventor: Tetsuro Mizuki, Nirasaki, Japan

[73] Assignee: Mitsui Kinzoku Kogyo Kabushiki Kaisha, Tokyo, Japan

[21] Appl. No.: 735,176

[22] Filed: Jul. 23, 1991

Related U.S. Application Data

[63] Continuation of Ser. No. 530,698, May 30, 1990, abandoned.

[30] Foreign Application Priority Data

Jun. 20, 1989 [JP] Japan ..... 1-157274

[51] Int. Cl.[5] ..... E05B 3/00

[52] U.S. Cl. ..... 292/216; 292/DIG. 27; 292/DIG. 65

[58] Field of Search ..... 292/216, 336.3, DIG. 27, 292/DIG. 25

[56] References Cited

U.S. PATENT DOCUMENTS 3,111,339 11/1963 Nadeau ..... 292/DIG. 65
3,923,329 12/1975 Torii et al. ..... 292/DIG. 27
4,334,704 6/1982 Yamada ..... 292/216
4,487,441 12/1984 Miyamoto et al. ..... 292/DIG. 65
4,492,395 1/1985 Yamada ..... 292/DIG. 65
4,900,074 2/1990 Kleefeldt ..... 292/DIG. 65
4,937,980 7/1990 Akachi et al. ..... 292/DIG. 65
4,969,673 11/1990 Portelli et al. ..... 292/DIG. 27

FOREIGN PATENT DOCUMENTS 35918 3/1979 Japan ..... 292/DIG. 65

*Primary Examiner*—Eric K. Nicholson
*Attorney, Agent, or Firm*—Browdy and Neimark

[57] ABSTRACT

The locking apparatus for a vehicle according to the present invention has a child-lock mechanism in which a door of the vehicle can be opened not by operating the inner door opener handle but by operating the outer door opener handle. The changeover control portion of this child-lock mechanism is designed to be rotated, pushed or pressed to function. The opening in which the changeover control portion is fitted is formed into the same shape as that of the changeover control portion so that no gap is formed therebetween. A lock-direction and an unlock direction are indicated on the outer surface of the changeover control portion.

6 Claims, 4 Drawing Sheets

CHILD-LOCK MECHANISM FOR LOCKING APPARATUS FOR VEHICLE

This application is a continuation of application Ser. No. 07/530,698, filed May 30, 1990, now abandoned.

FIELD OF THE INVENTION

The present invention relates to a locking apparatus for a vehicle. More particularly, the present invention relates to a locking apparatus having a child-lock mechanism in which a door of the vehicle can be opened not by operating the inner door opener handle of the door but by operating the outer door opener handle.

BACKGROUND OF THE INVENTION

A known control portion of a child-lock mechanism which performs changeover between a locked and an unlocked condition of a door of a vehicle is formed into a projection that can be moved left and/or right and is exposed to the outside of the door through an opening formed in the inner metal sheet of the door. The opening is shaped into an elongate hole so that the projection can move therein. Due to this construction, a wide gap is created between the control portion and the opening, and foreign matters such as dirt, dust, rainwater and so forth that accumulate inside the door get out of the door through this gap, and these foreign matters sometimes make the outer surface of the door dirty.

In addition, the control portion outwardly protrudes from the opening by substantially 1 cm, and due to this, a passenger's dress sometimes catches on the projection when he/she gets in and/or out of the vehicle.

SUMMARY OF THE INVENTION

An object of the invention is, therefore, to provide a locking apparatus that can not only eliminate the above mentioned drawbacks inherent in the prior art locking apparatuses but also exhibit good appearance, as well as a touch of high-quality.

THE PREFERRED EMBODIMENT

Figure 1:
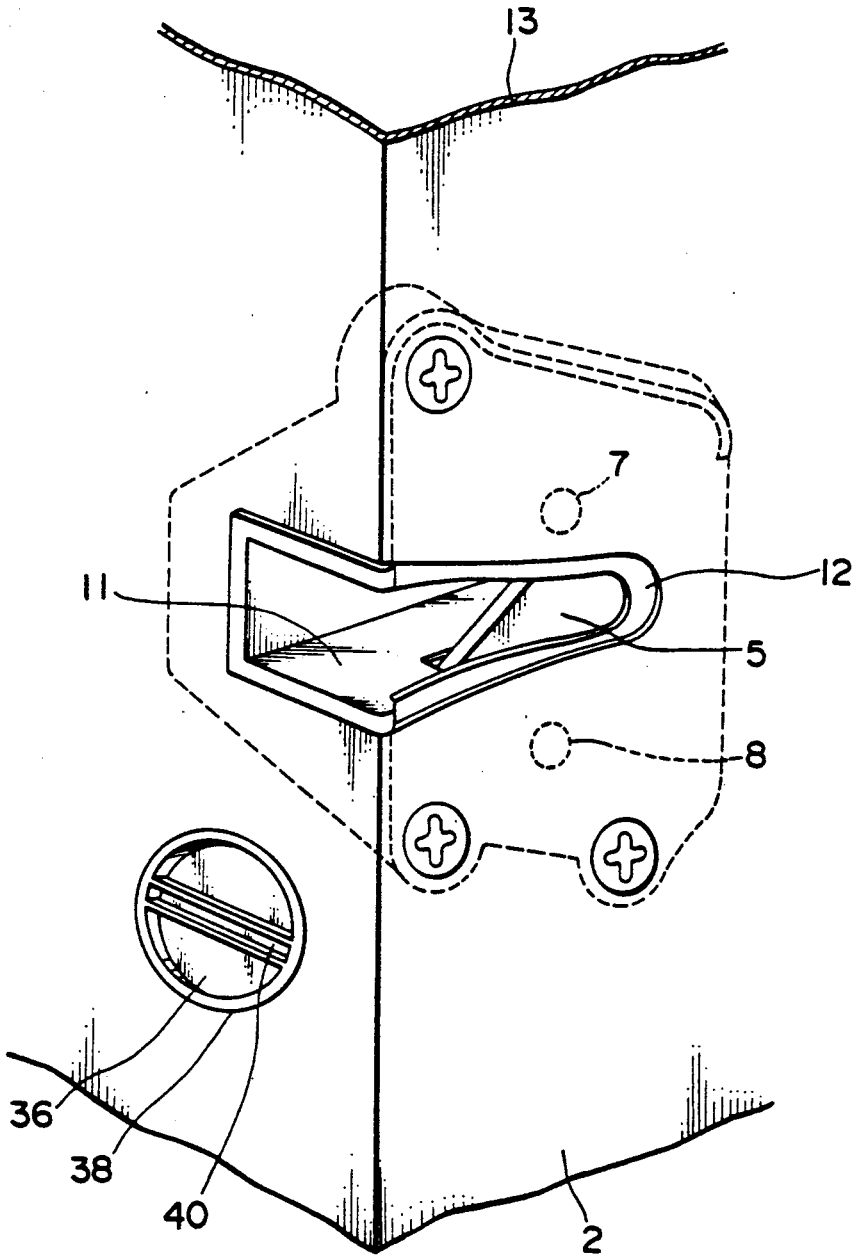
FIG. 1 is an external view of the locking apparatus installed in the door of a vehicle.
Figure 2:
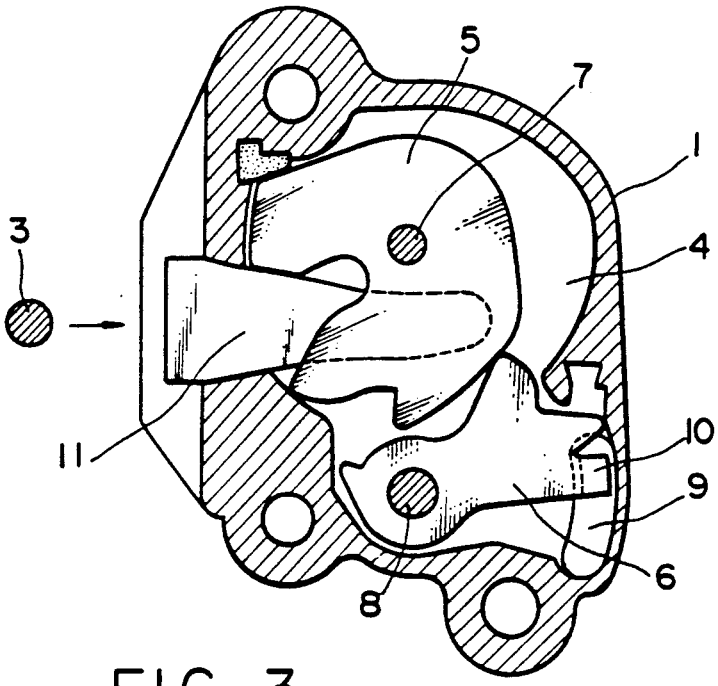
FIG. 2 is a vertical sectional front view of the body of the apparatus.
Figure 3:
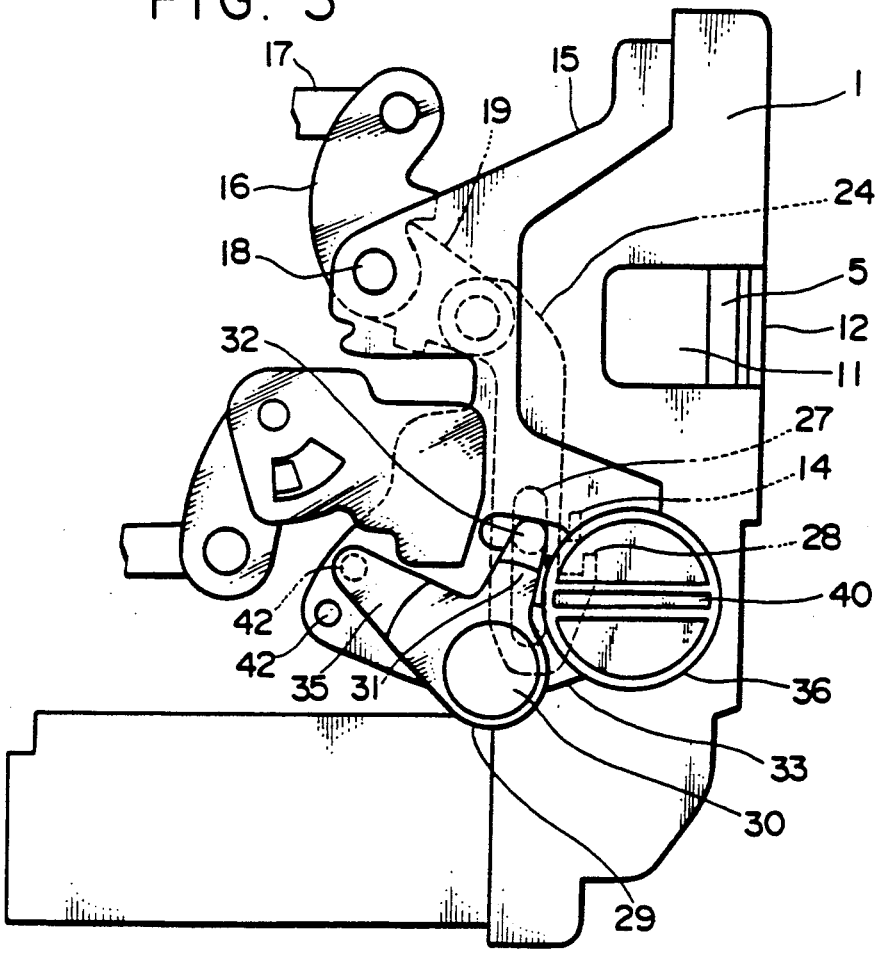
FIG. 3 is a left-hand side elevation of the locking apparatus.

Referring to the drawings, one embodiment of the present invention will be described. A cavity 4 is formed on the front side of the synthetic resin body 1 of a locking apparatus that is fixed to a door 2, and a latch 5 and a ratchet 6 are rotatably mounted on a shaft 7 and a shaft 8, respectively, in this cavity 4. The latch 5 is brought into engagement with a striker 3 fixed to the body of a vehicle, and the ratchet 6 prevents the reverse rotation of the latch 5. The cavity 4 is overlaid with a metal cover plate 12. The striker 3 enters the body 1 via a guide groove 11 formed therein.

A pin 10 is provided on the ratchet 6 in such a manner as to protrude toward the rear of the body 1 via a through hole 9 formed in the body 1. An opening lever 14 is provided on the rear side of the body 1 in such a manner as to be coupled with the pin 10 of the ratchet 6 via a main locking mechanism (not shown), and this opening lever 14 is coupled with an outer door opener handle (not shown) of the door 2. In this construction, therefore, with the main locking mechanism being in an unlocked condition, when the outer door opener handle is operated, the opening lever 14 is rotated, and the ratchet 6 is disengaged from the latch 5, the latter being thereby released from the engagement. Thus, the door can be opened.

A back plate 15 is provided on the rear side of the body 1, and an inner lever 16 and an intermediate arm 19 are, respectively, rotatably mounted on the back plate 15 by means of a shaft 18. This inner lever 16 is connected to the inner door opener handle (not shown) of the door 2 via a rod 17, and a bent piece 21 is formed on the inner lever 16 in such a manner as to come into engagement with a one end 20 of the intermediate arm 19. The upper end 25 of a link 24 is jointed to the other end 22 of the intermediate arm 19 via a shaft 23. A vertically elongate hole 27 and a hook 28 are formed on the lower portion 26 of the link 24. In this construction, therefore, when the inner door opener handle is operated, the inner lever 16 and intermediate arm 19 are rotated, and the link 24 moves upwardly.

A changeover unit 29 having three arms is rotatably mounted on the back plate 15 at the lower end thereof via a shaft 30. A projection 32 is formed on the leading end of a first arm 31 of the changeover unit 29, and this projection 32 is brought into engagement with an elongate hole 27 formed in the link 24. A toothed portion 34 is formed at the leading end of a second arm 33. A third arm 35 of the changeover unit 29 is brought into engagement with a positioning depressed portion 42 formed in the back plate 15.

Figure 4:
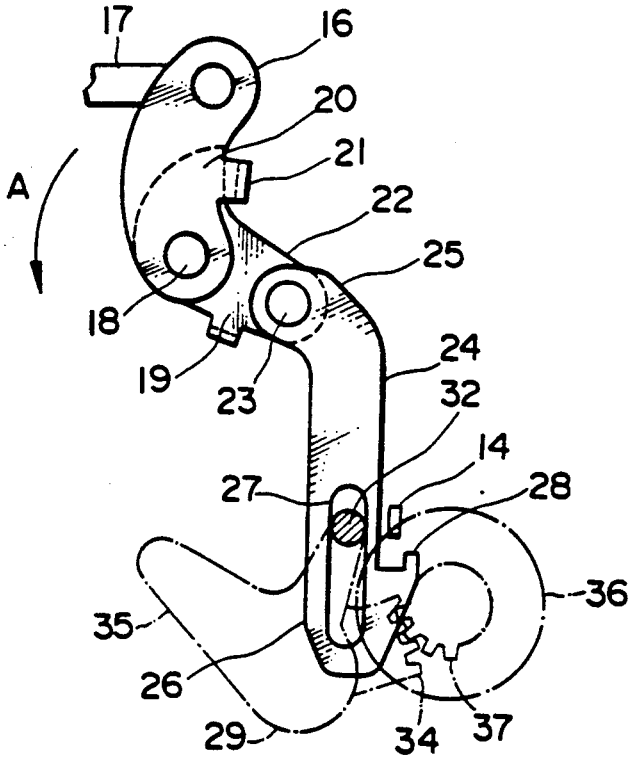
FIG. 4 is a drawing showing the relationship between a group of levers when the child-lock mechanism is in an unlocked condition.
Figure 5:
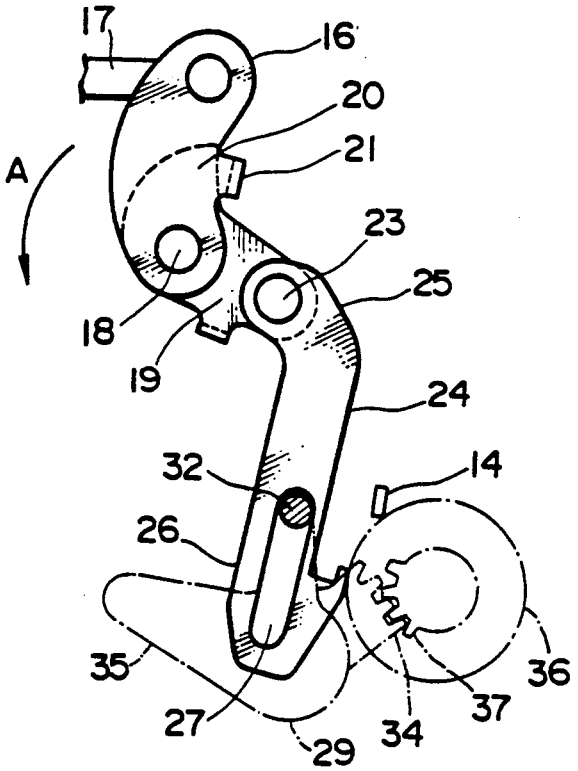
FIG. 5 is a drawing showing the relationship between the levers when the child-lock mechanism is in a locked condition.
Figure 6:
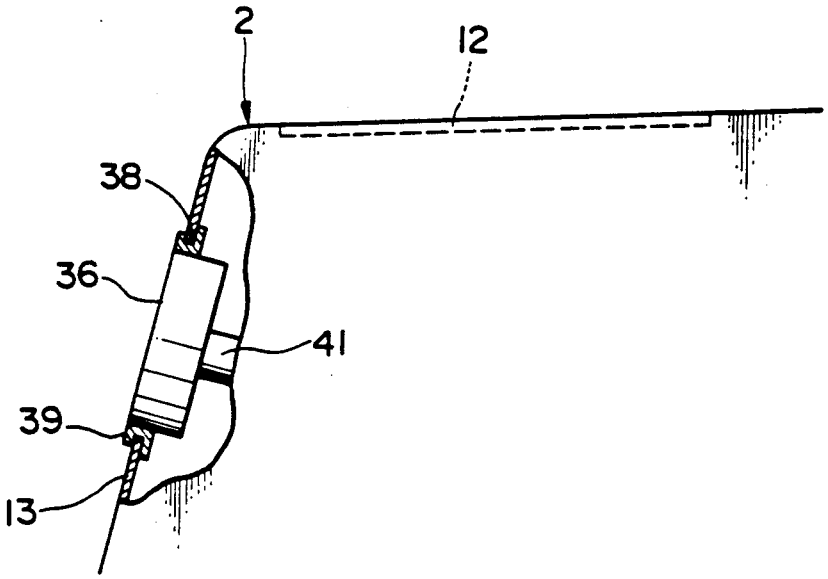
FIG. 6 is a partial vertical sectional view showing the relationship between the inner metal sheet of the door and the changeover control portion.

When the changeover unit 29 is rotated, since the projection 32 is in engagement with the elongate hole 27, the position of the link 24 is changed over so as to be either in a state in which a hook 28 and the leading end of the opening lever 14 are in engagement with each other (FIG. 4) or in a state in which the two members are out of engagement (FIG. 5). Thus, an idling mechanism provided by the changeover of the position of the link serves as the child-lock mechanism.

A disc-shaped changeover control portion 36 is provided in the vicinity of the changeover unit 29. A center shaft 41 for the changeover control portion 36 is rotatably fixed to the back plate 15, and a toothed portion 37 is formed on the center shaft 41 in such a manner as to be brought into mesh engagement with the toothed portion 34 of the second arm 33. A circular opening 38 having substantially the same diameter as that of the changeover control portion 36 is formed in an inner metal sheet 13 of the door 2, and the changeover control portion 36 is fitted in this opening 38 via a rubber ring 39 in such a manner as to leave no gap therebetween. The outer surface of the changeover control portion 36 is made substantially level with the surface of the metal sheet 13.

In this embodiment, the changeover control portion 36 is formed into a disk-like rotatable dial, but the control portion may be of a shape of a button that can be pushed or pressed to function. In this case, any shape of button may be used provided that the changeover control portion 36 and the opening 38 are formed into the same shape.

Figure 7:
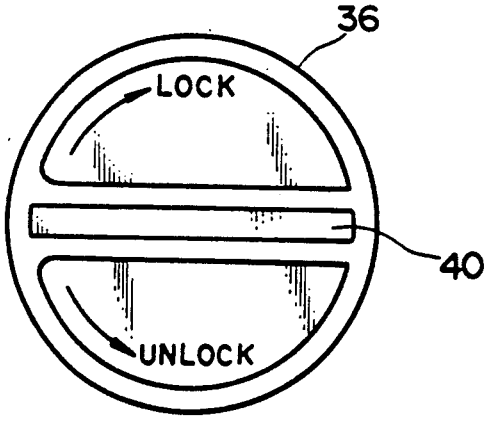
FIG. 7 is an enlarged plan view of the changeover control portion.

A engagement groove 40 is formed in the outer surface of the changeover control portion 36 so that a coin or the like can be inserted thereinto, and as shown in FIG. 7, direction indicators showing lock and unlock directions are also provided thereon.

The operation of the apparatus will be described.

First, the operation of the child-lock mechanism will be described. Let us now assume that every main locking mechanism is in an unlocked condition. With the hook 28 and the leading end of the opening lever 14 being in engagement with each other (FIG. 4), when the inner door opener handle is operated, the inner lever 16 is rotated in the direction shown by reference character A via the rod 17, the bent piece 21 and the end 20 of the intermediate arm 19 are brought into abutment with each other, and the intermediate arm 19 is then rotated about the shaft 18, the link 24 being thereby caused to move upwardly. This allows the hook 28 of the link 24 and the opening lever 14 to be brought into engagement with each other, and the opening lever 14 is rotated, and the ratchet 6 is then rotated via the pin 10. This frees the latch 5, and the striker is released, thereby making it possible to open the door.

In order to changeover the child-lock mechanism into a locked condition, the changeover control portion 36 being exposed to the outside of the door 2 through the opening 38 formed therein may be directly pinched by fingers, or a coin is inserted into the engagement groove 40 of the changeover control portion 36 for rotation thereof. When the changeover control portion 36 is rotated, the two toothed portions 37 an 34 are brought into mesh engagement with each other, the changeover unit 29 is then rotated. Since the projection 32 of the first arm 31 is in engagement with the elongate hole 27 of the link 24, the link 24 is moved to take a position as shown in FIG. 5, and the hook 28 is disengaged from the opening lever 14, the child-lock mechanism being thereby put into a locked condition.

When the inner door opener handle is operated in this condition, the inner lever 16 is rotated in the direction indicated by reference character A via the rod 17, and the bent piece 21 and the end 20 of the intermediate arm 19 are brought into abutment with each other. This rotates the intermediate arm 19 about the shaft 18, and the link is moved upwardly. However, since the hook 28 of the link 24 is, however, kept disengaged from the opening lever 14, the rotation of the opening lever 14 is not effected, and the door cannot be opened.

In order to open the door in a state as shown in FIG. 5, the outer door opener handle may be operated from the outside of the vehicle so as to rotate the opening lever 14. This allows the ratchet 6 to rotate via the pin.

As is clear from the above, since the opening 38 and the changeover control portion 36 are formed into the same shape, there is no gap between them, and no foreign matters are allowed to get out of the inside of the door 2. In addition, since the outer surface of the changeover control portion 36 is made substantially level with the surface of the metal sheet 13, there is no risk of the dress of the passenger catching on the changeover control portion 36 when he/she gets in and/or out of the vehicle. Furthermore, good appearance and a touch of high quality can be obtained.

I claim:

1. A locking apparatus having a child-lock mechanism fixed within a door of a vehicle in which said door can be opened not by operating an inner door opener handle of said door but by operating an outer door opener handle thereof, said locking apparatus having:

a latch designed to be brought into engagement with a striker fixed to the body of the vehicle;

a ratchet for maintaining the engagement between said latch and striker when said ratchet is brought into engagement with said latch;

an opening lever connected to said outer door opener handle for rotation of said ratchet so as to release the engagement between said ratchet and latch;

an intermediate member provided between said inner door opener handle and said opening lever and undergoing displacement between a locked position in which said inner door opener handle and said opening lever are out of engagement and an unlocked position in which said inner door opener handle and said opening lever are in engagement;

a changeover unit for changing over said intermediate member between the locked position and the unlocked position;

an opening formed in an inner metal sheet of said door; and a changeover control portion for controlling the changeover of said changeover unit exposed to an outside of the door through said opening in such a manner that said control portion can be directly pinched by fingers, said control portion having the same shape as that of said opening so as to leave no gap therebetween.

2. A locking apparatus as set forth in claim 1, wherein said changeover control portion is formed into a disc that can be freely rotated.

3. A locking apparatus as set forth in claim 2, wherein said changeover control portion is made level with said opening.

4. A locking apparatus as set forth in claim 2, wherein a lock-direction and an unlock-direction are indicated on the outer surface of said changeover control portion.

5. A locking apparatus as set forth in claim 1, wherein said changeover control portion is constructed to be pushed to function.

6. A locking apparatus as set forth in claim 1, wherein said changeover control portion is constructed to be pressed to function.

* * * * *

US005092638A

REEXAMINATION CERTIFICATE (2526th)

United States Patent [19]

Mizuki

[11] B1 5,092,638

[45] Certificate Issued Apr. 4, 1995

[54] CHILD-LOCK MECHANISM FOR LOCKING APPARATUS FOR VEHICLE

[75] Inventor: Tetsuro Mizuki, Nirasaki, Japan

[73] Assignee: Mitsui Kinzoku Kogyo Kabushiki Kaisha, Tokyo, Japan

Reexamination Request:
No. 90/003,378, Mar. 30, 1994

Reexamination Certificate for:

| | |
|---|---|
| Patent No.: | **5,092,638** |
| Issued: | **Mar. 3, 1992** |
| Appl. No.: | **735,176** |
| Filed: | **Jul. 23, 1991** |

Related U.S. Application Data

[63] Continuation of Ser. No. 530,698, May 30, 1990, abandoned.

[30] Foreign Application Priority Data

Jun. 20, 1989 [JP] Japan ..... 1-157274

[51] Int. Cl.[6] ..... E05B 3/00

[52] U.S. Cl. ..... 292/216; 292/DIG. 27; 292/DIG. 65

[58] Field of Search ..... 292/216, DIG. 27, DIG. 65, 292/336.3

[56] References Cited

U.S. PATENT DOCUMENTS

| | | | |
|---|---|---|---|
| 5,046,769 | 9/1991 | Rimbey et al. | 292/DIG. 27 |
| 5,052,731 | 10/1991 | Hayakawa et al. | 292/336.3 |
| 5,125,701 | 6/1992 | Hayakawa et al. | 292/DIG. 65 |

FOREIGN PATENT DOCUMENTS 62-196871 12/1987 Japan .

*Primary Examiner*—Eric K. Nicholson

[57] ABSTRACT

The locking apparatus for a vehicle according to the present invention has a child-lock mechanism in which a door of the vehicle can be opened not by operating the inner door opener handle but by operating the outer door opener handle. The changeover control portion of this child-lock mechanism is designed to be rotated, pushed or pressed to function. The opening in which the changeover control portion is fitted is formed into the same shape as that of the changeover control portion so that no gap is formed therebetween. A lock-direction and an unlock direction are indicated on the outer surface of the changeover control portion.

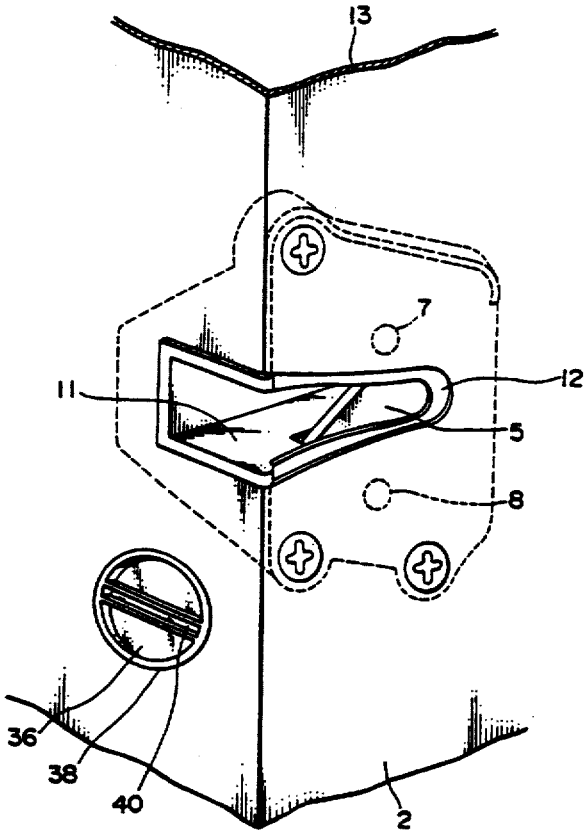

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–6 dependent on an amended claim, are determined to be patentable.

New claims 7–11 are added and determined to be patentable.

1. A locking apparatus having a child-lock mechanism fixed within a door of a vehicle in which said door can be opened not by operating an inner door opener handle of said door but by operating an outer door opener handle thereof, said locking apparatus having:

a latch designed to be brought into engagement with a striker fixed to the body of the vehicle;

a ratchet for maintaining the engagement between said latch and striker when said ratchet is brought into engagement with said latch;

an opening lever connected to said outer door opener handle for rotation of said ratchet so as to release the engagement between said ratchet and latch;

an intermediate member provided between said inner door opener handle and said opening lever and undergoing displacement between a locked position in which said inner door opener handle and said opening lever are out of engagement and an unlocked position in which said inner door opener handle and said opening lever are in engagement, *said intermediate member comprising an elongated link (24) laterally shiftable between the locked position and the unlocked position and having a first cooperative sliding member (27) at a lower end thereof;*

*wherein a longitudinal axis of said elongated link is parallel to a front surface of the lock body and is moved vertically by said inner door handle as said intermediate link engages said opening lever when said intermediate member is in said unlocked position;*

*said longitudinal axis being at an acute angle to the front surface when said intermediate member is in said locked position to allow said intermediate member to narrowly miss engagement with said opening lever when said intermediate member is moved by said inner door handle;* a changeover unit for changing over said intermediate member between the locked position and the unlocked position, *said changeover unit including a second cooperative sliding member (32) engaging with and capable of sliding relative to said first cooperative sliding member (27) of said elongated link (24) to cause said elongated link lower end to shift sidewardly away from said opening lever;* an opening formed in an inner metal sheet of said door; and a changeover control portion for controlling the changeover of said changeover unit exposed to an outside of the door through said opening in such a manner that said control portion can be directly pinched by fingers, said control portion having the same shape as that of said opening so as to leave no gap therebetween.

*7. A locking apparatus according to claim 1, wherein said elongated link (24) is pivotally mounted at an upper end (25) thereof.*

*8. A locking apparatus having a child-lock mechanism fixed within a door of a vehicle in which said door can be opened not by operating an inner door opener handle of said door but by operating an outer door opener handle thereof, said locking apparatus having:*

*a latch designed to be brought into engagement with a striker fixed to the body of the vehicle;*

*a ratchet for maintaining the engagement between said latch and striker when said ratchet is brought into engagement with said latch;*

*an opening lever connected to said outer door opener handle for rotation of said ratchet so as to release the engagement between said ratchet and latch;*

*an inner lever (16) connected to said inner door opener handle for rotation of said ratchet so as to release the engagement between said ratchet and latch, said inner lever (16) having a lower end thereof, and an intermediate arm (19) pivotally connected to said inner lever (16) at said lower end;*

*an intermediate member provided between said inner door opener handle and said opening lever and undergoing displacement between a locked position in which said inner door opener handle and said opening lever are out of engagement and an unlocked position in which said inner door opener handle and said opening lever are in engagement, said intermediate member comprising an elongated link (24) having an upper end and a lower end laterally shiftable between the locked position and the unlocked position, said elongated link (24) being connected at said upper end (25) to said intermediate arm (19);*

*a changeover unit for changing over said intermediate member between the locked position and the unlocked position and comprising means for laterally shifting said lower end of said elongated link (24);*

*an opening formed in an inner metal sheet of said door; and*

*a changeover control portion for controlling the changeover of said changeover unit exposed to an outside of the door through said opening in such a manner that said control portion can be directly pinched by fingers, said control portion having the same shape as that of said opening so as to leave no gap therebetween.*

*9. A locking apparatus in accordance with claim 8, wherein said upper end (25) of said elongated link (24) is pivotally connected to said intermediate arm (19).*

*10. A locking apparatus having a child-lock mechanism fixed within a door of a vehicle in which said door can be opened not by operating an inner door opener handle of said door but by operating an outer door opener handle thereof, said locking apparatus having:*

*latch designed to be brought into engagement with a striker fixed to the body of the vehicle;*

*a ratchet for maintaining the engagement between said latch and striker when said ratchet is brought into engagement with said latch;*

*an opening lever connected to said outer door opener handle for rotation of said ratchet so as to release the engagement between said ratchet and latch;*

*an intermediate member provided between said inner door opener handle and said opening lever and undergoing displacement betwween a locked position in which said inner door opener handle and said opening lever are out of engagement and an unlocked position in which said inner door opener handle and said opening lever are in engagement, said intermediate member comprising an elongated link (24) vertically shiftable in said unlocked position to engage said opening lever;*

*wherein a longitudinal axis of said elongated link is parallel to a front surface of the lock body and is moved vertically by said inner door handle as said intermediate link engages said opening lever when said intermediate member is in said unlocked position;*

*said longitudinal axis being at an acute angle to the front surface when said intermediate member is in said locked position to allow said intermediate member to narrowly miss engagement with said opening lever when said intermediate member is moved by said inner door handle;*

*a changeover unit for changing over said intermediate member between the locked position and the unlocked position, said changeover unit comprising means for laterally shifting said elongated link (24);*

*an opening formed in an inner metal sheet of said door; and*

*a changeover control portion for controlling the changeover of said changeover unit exposed to an outside of the door through said opening in such a manner that said control portion can be directly pinched by fingers, said control portion having the same shape as that of said opening so as to leave no gap therebetween.*

*11. A locking device according to claim 10, wherein said elongated link (24) is pivotally mounted at an upper end thereof.*

* * * * *